US005474124A

United States Patent [19]

Samuels et al.

[11] Patent Number: 5,474,124

[45] Date of Patent: Dec. 12, 1995

[54] WELLHEAD RETRIEVAL TOOL ASSEMBLY

[76] Inventors: Martin L. Samuels, 2634 Yorktown #390, Houston, Tex. 77056; Bashir M. Koleilat, 17826 Mahogany Forest, Spring, Tex. 77379; David E. Cain, 1502 Anvil, Houston, Tex. 77099; John R. Herold, 7314 Kite Hill Dr., Houston, Tex. 77041; Neil C. Crawford, 4019 Fir Forest, Spring, Tex. 77380

[21] Appl. No.: 296,763

[22] Filed: Aug. 26, 1994

[51] Int. Cl.[6] ..... E21B 23/00

[52] U.S. Cl. ..... 166/85.1; 166/98; 166/237; 294/86.18; 294/86.25

[58] Field of Search ..... 166/85, 98, 217, 166/237; 294/86.18, 86.25

[56] References Cited

U.S. PATENT DOCUMENTS

| | | | |
|---|---|---|---|
| 2,994,280 | 8/1961 | Daffin | 166/217 X |
| 3,645,328 | 2/1972 | Greene, Jr. | 166/85 |
| 3,856,081 | 12/1974 | Canalizo | 166/217 X |
| 3,874,447 | 4/1975 | McGowen, Jr. | 166/214 |
| 4,153,111 | 5/1979 | Lans et al. | 166/85 X |
| 4,254,983 | 3/1981 | Harris | 294/86.25 |
| 4,625,381 | 12/1986 | Gravonia, Jr. et al. | 166/85 X |
| 4,793,411 | 12/1988 | Zunkel | 166/98 |
| 5,145,228 | 9/1992 | Boyle | 294/86.25 |

*Primary Examiner*—Hoang C. Dang
*Attorney, Agent, or Firm*—Lawrence Cruz

[57] ABSTRACT

A wellhead retrieval tool assembly for retrieving a check valve has a spear formed as a solid ring at the bottom with free fingers extending upward. The fingers are resilient and have protrusions adapted to engage a retrieval groove in the check valve. A wedge ring is provided on the tool body to positively lock the fingers in radially outward engagement with the retrieval groove. The wedge ring is fixed to the body by a shear pin so that upon a predetermined axial force the pin shears and releases the wedge allowing withdrawal of the tool assembly.

7 Claims, 2 Drawing Sheets

WELLHEAD RETRIEVAL TOOL ASSEMBLY

BACKGROUND OF THE INVENTION

The present invention relates to wellhead tools and, more particularly, to retrieval tools for back pressure or tree test valves.

A back pressure valve is a check valve installed in a tubing hanger or coupling to retain pressure in a well below a valve. A tree test plug is a check valve installed in a tubing hanger or coupling to retain pressure in a christmas tree above a valve. Typically, a tree test plug is used to seal off pressure adjacent to a blowout preventer and christmas tree mounted on a well so that pressurized fluid can be used to test these devices. Back pressure and tree test plug check valves ordinarily have generally cylindrical bodies with an outside diameter slightly smaller than the bore of the well and are landed on a shoulder in the bore and secured by radially extending members.

Existing retrieval tools comprise generally ring-shaped, unitary bodies having axially extending "fingers" which are fixed to the ring body at the upper end and are freely extending at the lower end. The fingers have spring-like properties and together with the ring body form what is referred to as a "spear". The fingers are provided with members that extend radially outward and are adapted to engage a corresponding retrieval groove on the inner diameter of the check valve to be retrieved. The free ends or other potions of the finger have wedge-shaped outer surfaces below the radially extending members in order to bias the fingers radially inward through camming action during insertion of the spear into the check valve until the extension engages the groove causing the fingers to expand radially outward to lock the spear relative to the valve. Once positioned and locked, the retrieval tool can be used to pull the check valve out of the tubing hanger or coupling.

Such existing retrieval tools are subject to several drawbacks during normal use. Problems arise when, in the case of a christmas tree for instance, a gate valve is inadvertently left partially closed or partially opened restricting the open bore area through which the retrieval tool is supposed to pass. If during insertion one or more fingers get caught on a partially closed gate, or if the fingers are off center, the free end of one or more of the fingers may get caught and be subjected to loads which may damage or deform the fingers. Similar problems can occur when a retrieval tool is run through a blow out preventer stack. Permanent deformation of a finger may prevent the retrieval tool from properly engaging the check valve. Sometimes back pressure valves and tree test plugs get stuck inside the hanger and coupling such that ordinary pulling or retrieval force cannot remove them. In such instances, it is desirable to have a retrieval tool which is capable of releasing from a stuck check valve.

SUMMARY OF THE INVENTION

The present invention provides a novel retrieval tool assembly and associated method for retrieving back pressure or tree test plug check valves, including means for releasing from a stuck check valve. The retrieval tool comprises a spear which is formed as a solid ring at the bottom having free end fingers extending upward. This design reduces the chance of the fingers getting caught on surrounding structure during insertion. The spear is structured such that in any situation all the fingers together resist collapse so that a compressing force would have to overcome the combined strength of all the fingers rather than one.

The retrieval tool is provided with means for engaging by radial expansion, an inner circumferential retrieval groove in the back pressure valve or tree test valve. Further provided are means for releasing and withdrawing the retrieval tool from the valve in the event that the valve becomes stuck while the tool is pulling or lifting the valve.

DETAILED DESCRIPTION OF THE DRAWINGS

Figure 1:
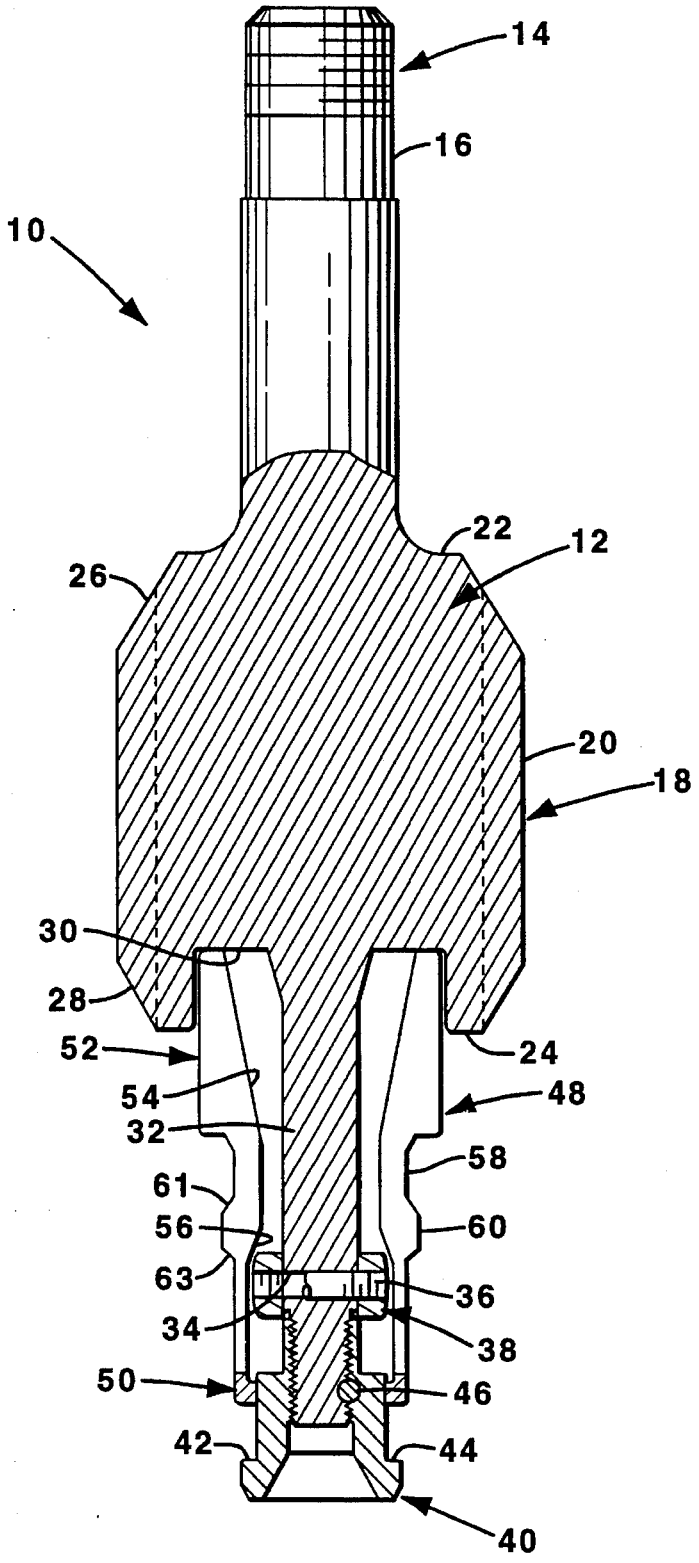
FIG. 1 is a partial, sectional view of the retrieval tool assembly of the present invention.

The present invention retrieval tool assembly 10 is illustrated in FIG. 1. The assembly 10 comprises a generally cylindrical body 12 having a first end 14 comprising a stem 16 adapted for engagement with conventional means (not shown) for operating and manipulating retrieval tools. The body 12 has a middle portion 18 having an enlarged diameter portion 20 with an upper end 22 and a lower end 24. The upper end 22 and lower end 24 are provided with beveled edges 26, 28, respectively. The lower end 24 of the body 12 is provided with an annular axial recess 30. A lower stem 32 extends from the lower end of the middle portion 18 in a direction opposite the first end 14. The lower stem 32 is provided with a through hole 34 adapted to accommodate a shear pin 36 which supports a wedge ring 38 around the lower stem 32. The lower stem 32 has fixed to its lower end a lift nut 40 with radially extending ends 42 having an upward-facing support surface 44. The lift nut 40 can be fixed to the lower stem 32 by a roll pin 46 or similar means. The assembly 10 is further provided with a spear 48 being formed of a solid ring section 50 at its lower end. The spear has a plurality of axially extending fingers 52. Preferably, the fingers 52 and ring 50 are unitary. The fingers 52 have spring properties. The spear 48 is positioned around the lower stem 32 such that the fingers 52 extends upward and are received in the annular axial recess 30. The inner surface 54 of each finger 52 has a wedge-like cam surface 56 adapted to engage the wedge ring 38 to limit downward movement of the spear 48. The outer surface 58 of each finger 52 is provided with a radially protruding, annular wedge member 60, having upper and lower wedge surfaces 61, 63 respectively.

Operation of the present invention is described with reference to FIG. 2 for a back pressure valve or a tree test plug, both being essentially the same for purposes of describing the present invention.

Figure 2:
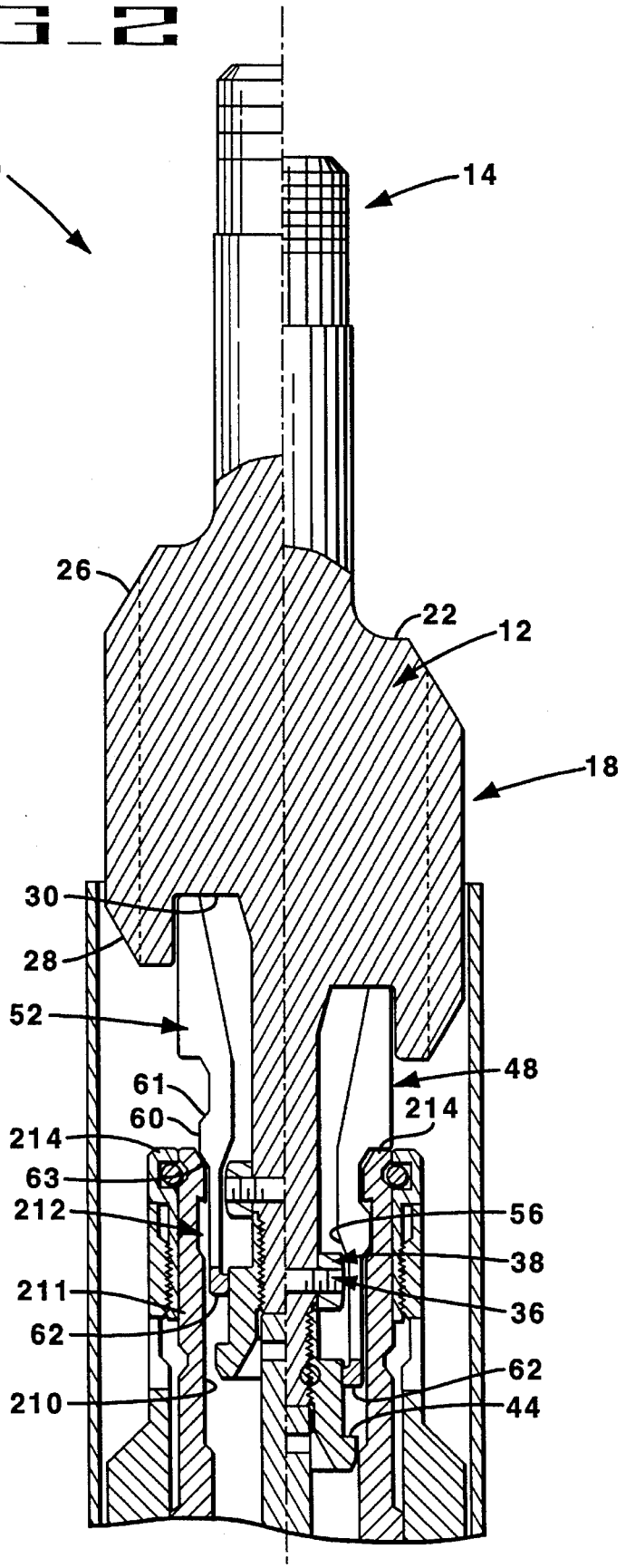
FIG. 2 is a partial, sectional split view of the retrieval tool assembly of the assembly of FIG. 1 engaged in a check valve of the type used for a back pressure valve or a tree test plug.

The retrieval tool assembly 10 is shown in the disengaged and engaged positions at the left and right sides of FIG. 2, respectively. The inner circumferential surface 210 of the valve sleeve 211 has a dedicated retrieval groove 212 adapted for engagement with the wedge member 60. The assembly 10 is inserted such that the wedge member 60 lower surface 63 engages an angled upper edge 214 of the sleeve 211, causing the fingers to be biased radially inward until the wedge surface 60 aligns with the retrieval groove 212. Once the wedge surface 60 is aligned with the groove 212, the fingers 52 spring radially outward so the wedge surface 60 is biased firmly into the retrieval groove 212. At that point, the tool body 12 is withdrawn, causing the wedge ring 38 to contact the cam surface 56 and bias the spear 48 and valve upward for removal.

In the event that the valve becomes stuck, the shear pin 36 will shear at a predetermined load, causing the wedge ring 38 to drop down from engagement with the cam surface 56. Then, continued movement of the body 12 will cause the support surface 44 to engage the lower end 62 of the spear 48 and provide upward force. This upward force causes the wedge member upper surface 61 to engage the inner circumferential surface 210 and bias fingers 52 radially inward as the body 12 is withdrawn, releasing the wedge member 60 from the retrieval groove 212. Once the wedge member 60 is removed from the retrieval groove 212, the tool assembly 10 can be removed from the stuck valve.

During the operation, the upward force can be applied by a human operator or by conventional mechanical or hydraulic means. While the check valve is being removed under normal conditions, there is no possibility that the fingers 52 will inadvertently be biased inward causing premature release of the check valve, since the wedge ring 38 prevents such biasing by being positioned against the fingers 52 at the cam surface 56.

While the preferred embodiment of the invention has been herein shown and described, it is understood that modification and variation can be made without departing from what is regarded as the scope of the present invention.

What is claimed is:

1. A wellhead retrieval tool assembly for retrieving a valve comprising:

a generally cylindrical tool body having a first end, a second end, and a middle section;

said first end being adapted to receive means for grasping and manipulating said tool body;

a spear comprising a generally ring-shaped base having a plurality of resilient fingers extending therefrom and having free ends opposite said base;

said base being positioned generally concentrically around said second end of said body such that said fingers extend toward said middle section;

retaining means positioned on said second end adapted to retain said spear on said body while permitting limited axial movement of said spear on said body;

wedge means for engagement with an inner cam surface on each of said fingers when said body is moved relative to said spear whereby said wedge means and cam surfaces bias said fingers radially outward when said spear is moved axially relative to said body, said wedge means being releasably fixed to said body;

engagement means extending radially on the outer surface of each said finger for engaging an annular retrieval groove on an inner circumferential surface of said valve when said tool assembly is inserted concentrically in said valve;

shear means for releasably fixing said wedge means to said body, said shear means being adapted to shear and release said wedge means from said body causing said wedge means to fall out of engagement with said cam surfaces when an axial force imposed on said wedge means attributable to said relative axial movement between said body and said spear reaches a predetermined limit, whereby continued relative movement causes said retaining means to contact said spear and cause said spear to move with said body.

2. A tool assembly according to claim 1, wherein said retaining means comprises a lift nut having a radially extending flange forming an upper lift surface adapted to engage the bottom of said base.

3. A tool assembly according to claim 1, wherein said wedge means comprise a ring.

4. A tool assembly according to claim 3, wherein said ring has beveled upper and lower surfaces.

5. A tool assembly according to claim 1, wherein said engagement means comprise a radially extending portion positioned on each finger such that each portion simultaneously engages an inner circumferential annular groove on said valve.

6. A tool assembly according to claim 1, wherein said shear means comprise a shear pin.

7. A tool assembly according to claim 1, wherein said fingers are adapted to be biased radially inward when said tool assembly is withdrawn from said valve after said wedge means is released.

* * * * *